US010349717B2

(12) United States Patent
Hamzaee et al.

(10) Patent No.: US 10,349,717 B2
(45) Date of Patent: Jul. 16, 2019

(54) OBJECT-SECURABLE ARTICLE-CARRIER APPARATUS AND KIT

(71) Applicant: MQHG, LLC, San Jose, CA (US)

(72) Inventors: Maanie Hamzaee, San Jose, CA (US); Kiumars Ghadjar, Santa Clarita, CA (US); Mathew Finuf, Castle Rock, CO (US)

(73) Assignee: MQHG, LLC, Campbell, CA (US)

( * ) Notice: Subject to any disclaimer, the term of this patent is extended or adjusted under 35 U.S.C. 154(b) by 0 days.

(21) Appl. No.: 15/746,409

(22) PCT Filed: Sep. 29, 2017

(86) PCT No.: PCT/US2017/054590
§ 371 (c)(1),
(2) Date: Jan. 20, 2018

(87) PCT Pub. No.: WO2018/064620
PCT Pub. Date: Apr. 5, 2018

(65) Prior Publication Data

US 2019/0014876 A1 Jan. 17, 2019

Related U.S. Application Data

(60) Provisional application No. 62/401,856, filed on Sep. 29, 2016.

(51) Int. Cl.
*A45C 13/26* (2006.01)
*A45C 13/28* (2006.01)
*A45C 13/30* (2006.01)

(52) U.S. Cl.
CPC ..... *A45C 13/28* (2013.01); *A45C 13/262* (2013.01); *A45C 2013/306* (2013.01)

(58) Field of Classification Search
CPC ..... A45C 13/28; A45C 13/262; A45C 13/306; B65D 85/18
(Continued)

(56) References Cited

U.S. PATENT DOCUMENTS 946,850 A 1/1910 Tabler
1,348,102 A * 7/1920 Freyholtz ..... D06F 55/00 24/489
(Continued)

FOREIGN PATENT DOCUMENTS

DE 202006014316 U1 2/2007
WO 1995019721 A1 7/1995

*Primary Examiner* — Fenn C Mathew
*Assistant Examiner* — Cynthia F Collado
(74) *Attorney, Agent, or Firm* — Lance M. Pritikin, Esq.

(57) ABSTRACT

Exemplary embodiments of an object-securable article-carrier clip apparatus comprise a grip subassembly, and an object securement subassembly for robustly securing the grip subassembly to an object such as a piece of luggage. The grip subassembly has a mouth portion configured to grippingly retain an article, such as a garment, and may include an auxiliary support portion to supportingly receive a supportive component of the article, such as a coat hanger or bag strap. The auxiliary support portion may feature an article support groove with an opening opposite of the mouth portion. A luggage item with extendable handle may have a clip apparatus permanently affixed to the handle, and the grip subassembly may be at least partially received by a recess in the handle. An article-carrier kit may include a clip apparatus, and an article strap subsystem to further secure the article to the object during transport of the object.

15 Claims, 16 Drawing Sheets

(58) Field of Classification Search
USPC ..... 206/278–298; 24/3.11, 3.2, 507; 248/205.2, 316.7, 305, 306
See application file for complete search history.

(56) References Cited

U.S. PATENT DOCUMENTS 1,393,577 A * 10/1921 Ryason ..... A47G 21/165 224/182
2,258,076 A 10/1941 Taylor
3,664,224 A * 5/1972 Campagna, Jr. ..... G10G 5/00 248/230.8
3,914,828 A * 10/1975 Noda ..... A41F 3/02 24/489
4,639,980 A * 2/1987 Peterson ..... A61M 25/02 128/DIG. 14
4,759,431 A 7/1988 King et al.
4,887,784 A * 12/1989 Kayali ..... B60N 3/102 248/311.2
5,354,131 A 10/1994 Mogil
5,431,262 A 7/1995 Rekuc et al.
5,469,583 A * 11/1995 Akeley ..... A42B 3/08 2/421
5,671,832 A 9/1997 London et al.
5,802,677 A 9/1998 Dorman et al.
5,829,559 A 11/1998 Nordstrom et al.
5,842,673 A 12/1998 Fenton
5,863,021 A * 1/1999 Nichols ..... B25B 7/00 24/332
5,960,520 A * 10/1999 Conway ..... A47C 21/022 24/306
6,073,897 A * 6/2000 Warren ..... F16M 11/105 248/278.1
6,216,322 B1 4/2001 Kuo
6,302,366 B1 10/2001 Saylor et al.
6,390,431 B1 * 5/2002 Ott ..... A45C 13/00 248/229.23
6,490,768 B1 * 12/2002 Goodall ..... A47C 21/022 24/334
6,502,283 B1 * 1/2003 Aguirre ..... A45B 1/04 135/65
6,961,978 B2 11/2005 Earley et al.
7,559,115 B2 7/2009 Tong et al.
7,841,453 B2 11/2010 Gold et al.
8,245,825 B2 8/2012 Yoneno et al.
2008/0196988 A1 8/2008 Tong
2011/0132708 A1 6/2011 DeLine et al.
2013/0264160 A1 10/2013 Mediamolle
2014/0027227 A1 1/2014 Stern
2015/0027834 A1 1/2015 Kogelnik
2018/0271310 A1 * 9/2018 Klugh ..... A47G 23/0225
2018/0289127 A1 * 10/2018 McKelvey ..... A45C 13/28

* cited by examiner

OBJECT-SECURABLE ARTICLE-CARRIER APPARATUS AND KIT

RELATED APPLICATIONS

This application is a U.S. National Stage of International Application No. PCT/US17/54590, filed on Sep. 29, 2017, which claims the benefit of U.S. Provisional Application No. 62/401,856 filed Sep. 29, 2016, the contents of each of which are incorporated by this reference their entireties for all purposes as if fully set forth herein.

TECHNICAL FIELD

The present disclosure relates to the storage and transport of articles. More particularly, the present invention relates to a carrier system and kit that can be used to link to an article, such as, but not limited to a personal belonging, for the purpose of storage, retrieval, and transport of said article. More particularly, the present disclosure relates to a system and kit to enable storage and transport of articles for persons desiring continuous and immediate physical access to said articles during travel.

BACKGROUND

According to the US Travel Association, an estimated 2.2 billion person-trips were undertaken by US residents alone in 2014. Since 2011, the volume of trips has grown by approximately 2% every year, and is forecasted to continue growing annually by the same extent through the year 2020. Naturally, it follows that there is a perpetual demand for improved storage and access to articles, such as, but not limited to personal belongings, during travel. Reciprocally, improved methods for carriage of personal belongings may contribute positively to the travel industry—more convenient storage and access to personal items can simplify certain inconveniences of traveling, thus potentially increase willingness to travel and boosting travel expenditures as a whole.

During travel a person often desires to store an article and retrieve said article at a later point in time. For example, this article may include, but is not limited to, an over garment (such as a jacket, coat, suit coat, sweater or other comparable apparel). An example scenario might include an individual who may want to remove an over garment when encountering a change in ambient temperature, such as an airport terminal, for the purpose of physical comfort or convenience.

One current method for storing and transporting personal articles typically includes holding the article by hand. Carrying an article by hand severely limits that person from performing other potentially important functional tasks using said hand. For example, a person may be unable to use the article-carrying hand to make phone calls, write documents, or any other essential or non-essential tasks.

Another current method for storing and transporting articles includes placement of the article within the interior of a fixed-volume space. General examples of such boundary limited spaces might include, but are not limited to a handbag, backpack, garment bag, duffle bag, or carrying case such as a suitcase or luggage. These current transport methods that involve static volume, fixed-boundary spaces as just described do not allow for continuous and immediate physical access to the article in transport because said article is stored interiorly in an enclosed space. When the article is stored interiorly away from immediate physical access, a person will be at a disadvantage if direct and rapid physical retrieval is required of said article.

Furthermore, rolling, stuffing, packing or otherwise manipulating articles to fit within the above described confined spaces can cause considerable damage to the article itself. For example, damage might include unwelcome creasing of the fabric of an article.

Additional difficulties with current methods of article storage, access, and transport include the burdensome effort required for the act of article placement or retrieval from within an enclosed space. For example, said effort requires unzipping, unlocking, or otherwise opening an enclosed space (such as a suitcase or luggage, or other similar enclosed compartment typically used to transport articles). Moreover, the effort just described is often undertaken in undesirable areas, such as crowded airport terminals or in the small trunk of a motor vehicle, requiring further energy expenditure and impeding the ease of article storage, access, and transport.

SUMMARY

Certain deficiencies of the prior art are overcome by the provision of embodiments of an apparatus and kit in accordance with the present disclosure. Advantages of embodiments of the teachings disclosed herein include providing an apparatus and kit that (a) allows for quick, convenient and reliable carrying of an article, such as an article of clothing or secondary travel bag, on an object such as roller bag luggage while ensuring that the article remains readily accessible and (b) provides more than one means for supporting the article on the object.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
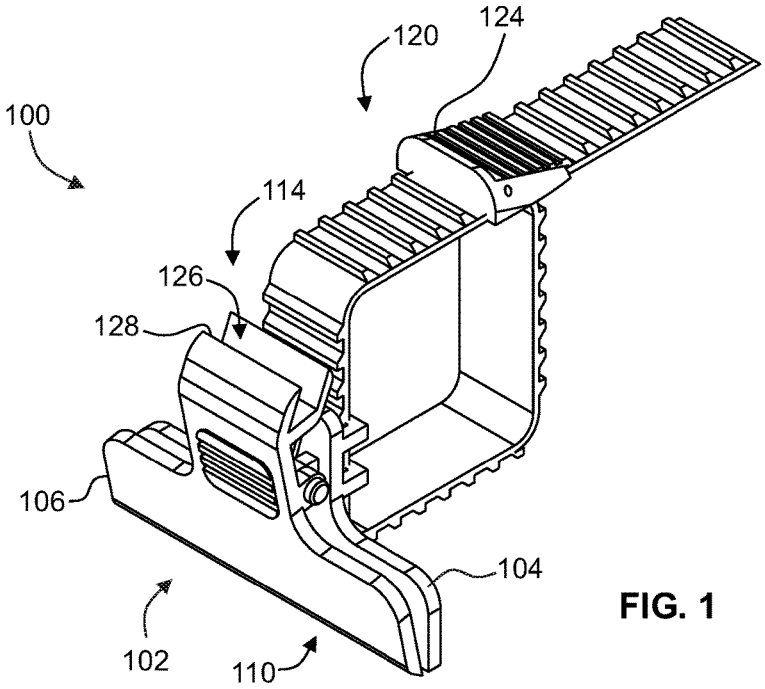
FIG. 1 is a diagrammatic perspective view of one example object-securable article-carrier clip apparatus in accordance with the present disclosure.
Figure 2:
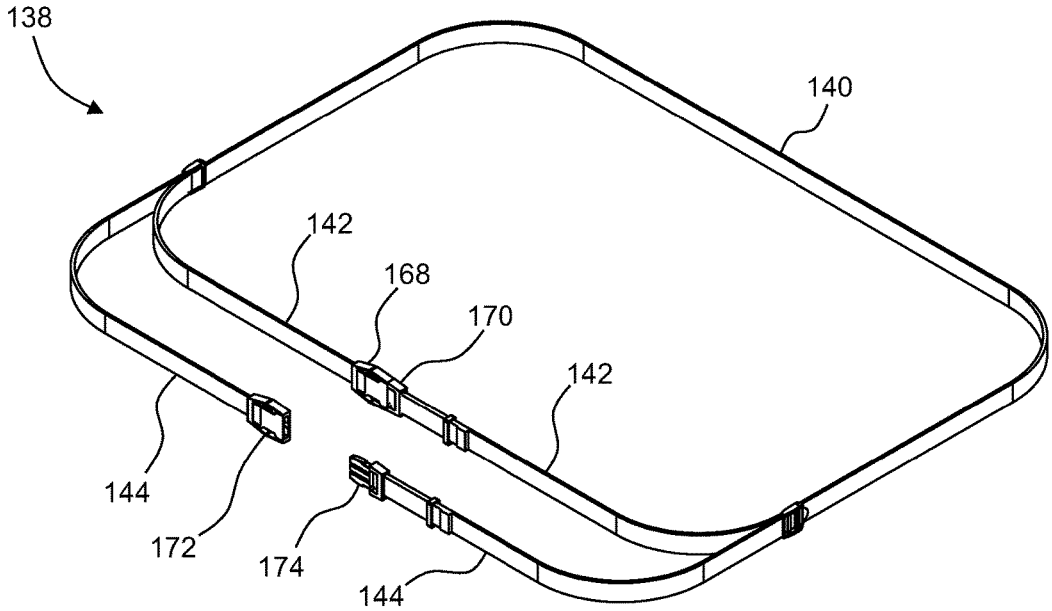
FIG. 2 is a further diagrammatic perspective view of one example article strap subassembly in accordance with the present disclosure.

Referring now to the drawings, like reference numerals designate identical or corresponding features throughout the several views.

With reference to the several drawings, various example embodiments of an object-securable article-carrier clip apparatus are shown at 100, and may comprise a grip subassembly 102 and an object securement subassembly 148 configured to secure the grip subassembly 102 to an object 122. By way of example, an object 122 may preferably be a luggage item or similar travel-type baggage device.

Figure 11:
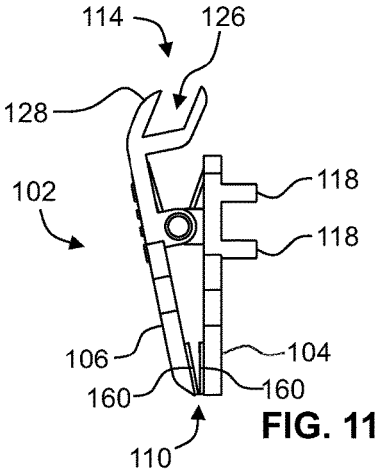
FIG. 11 is a diagrammatic side view of the example grip subassembly shown in FIG. 9, wherein the second grip element is shown in a gripping position with respect to the first grip element.
Figure 12:
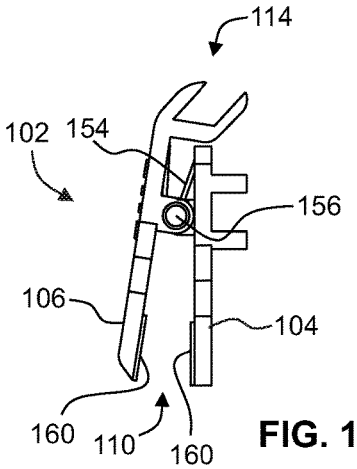
FIG. 12 is a diagrammatic side view similar to that of FIG. 11, but wherein the second grip element is shown it a release position achieved by a user manually overcoming the resilient bias of second grip element toward its grip position.
Figure 19:
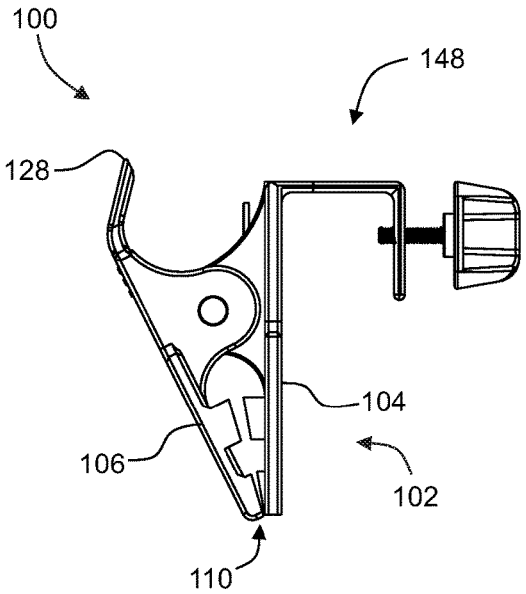
FIG. 19 is a diagrammatic side view of the object-securable article-carrier clip apparatus shown in FIG. 18, showing the second grip element in a grip position and the securement clamp element in an unclamped configuration.
Figure 20:
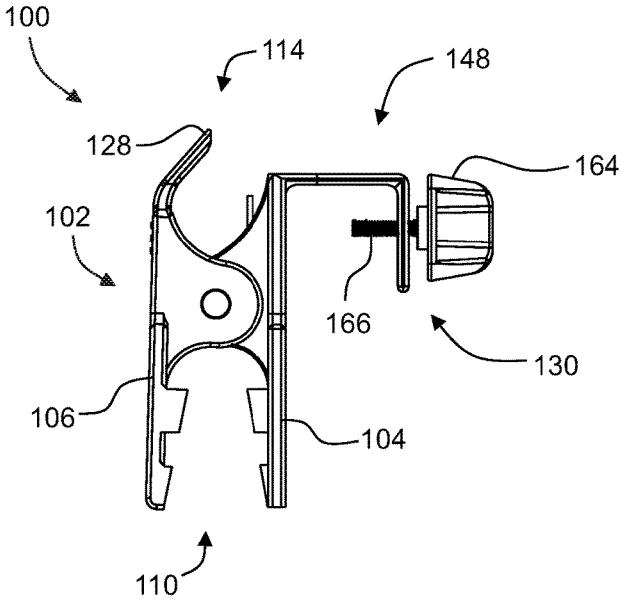
FIG. 20 is a diagrammatic side view similar to that of FIG. 19, but showing the second grip element in a release position and the securement clamp element in a clamped configuration.
Figure 21:
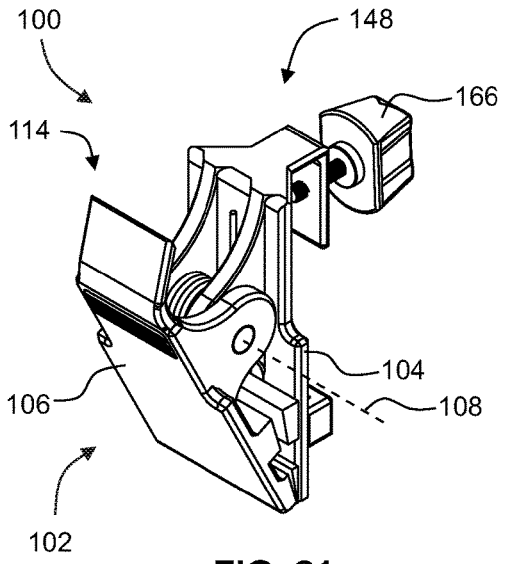
FIG. 21 is a diagrammatic perspective view of another alternate example of an object-securable article-carrier clip apparatus in accordance with the present disclosure, wherein the object securement subassembly further includes a securement hook member.
Figure 22:
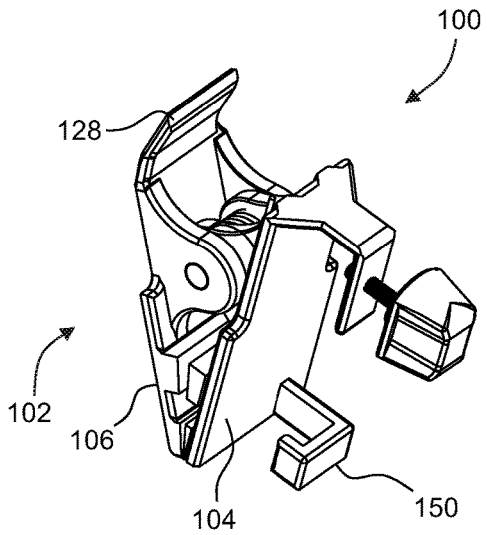
FIG. 22 is a further diagrammatic perspective view of the example of an object-securable article-carrier clip apparatus of FIG. 21.
Figure 23:
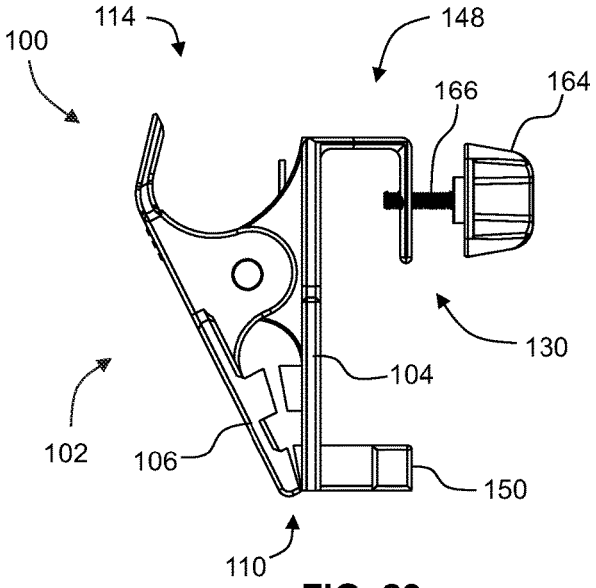
FIG. 23 is a diagrammatic side view of the object-securable article-carrier clip apparatus shown in FIG. 21, showing the second grip element in a grip position and the securement clamp element in an unclamped configuration.
Figure 24:
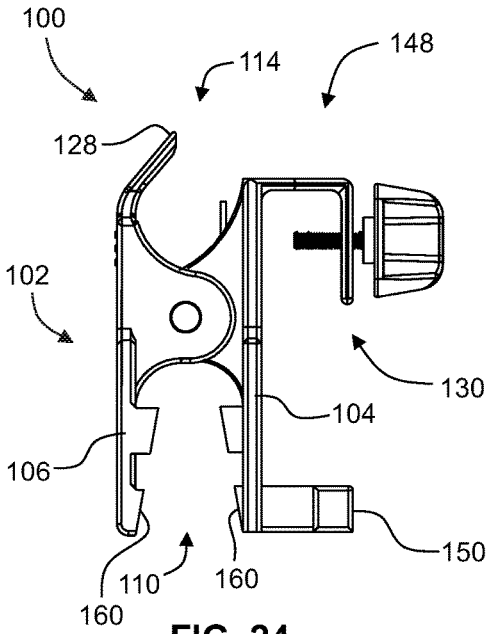
FIG. 24 is a diagrammatic side view similar to that of FIG. 23, but showing the second grip element in a release position and the securement clamp element threadedly actuated into a clamped configuration.
Figure 25:
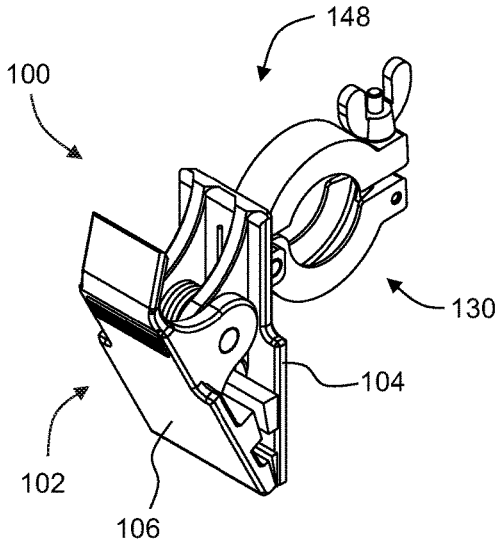
FIG. 25 is a diagrammatic perspective view of another alternate example of an object-securable article-carrier clip apparatus in accordance with the present disclosure, wherein the object securement subassembly includes a clamp element which can be locked in and released from its clamping configuration by movement of a rotatable locking shaft with complementary threaded wingnut.
Figure 26:
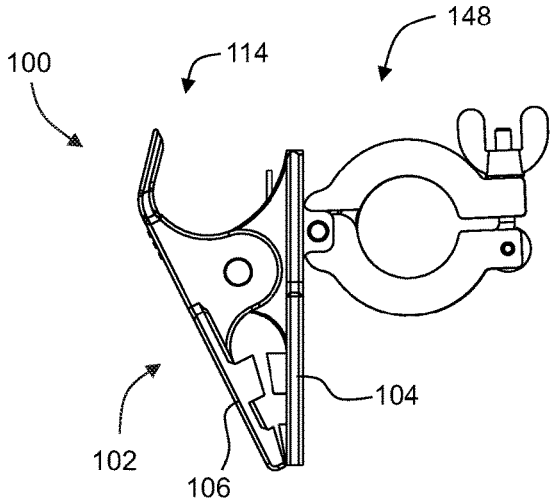
FIG. 26 is a diagrammatic side view of the object-securable article-carrier clip apparatus shown in FIG. 25, showing the second grip element in a grip position and the securement clamp element in a clamped configuration.
Figure 27:
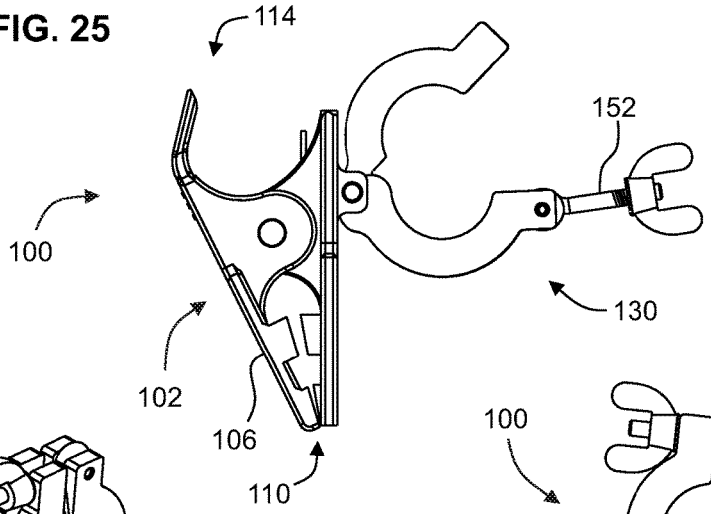
FIG. 27 is a diagrammatic side view similar to that of FIG. 26, but wherein the locking shaft is in an unlocked orientation thereby releasing the securement clamp element to move to an unclamped configuration.
Figure 28:
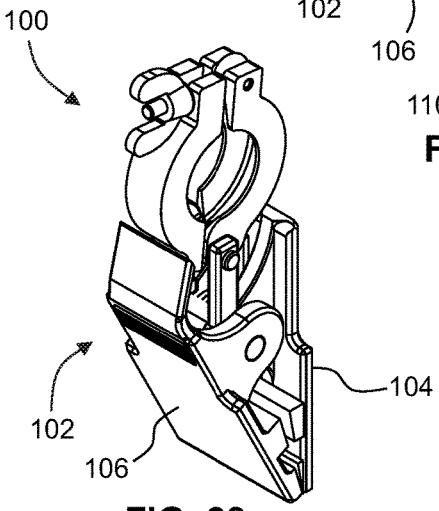
FIG. 28 is a diagrammatic perspective view of an example object-securable article-carrier clip apparatus similar to that of FIG. 25, but wherein the securement clamp element is connected to the grip subassembly by way of a pair of clamp extension arms.
Figure 29:
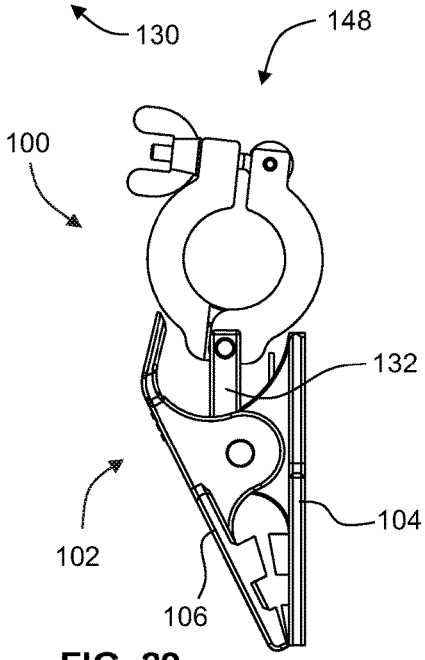
FIG. 29 is a diagrammatic side view of the object-securable article-carrier clip apparatus of FIG. 28.
Figure 30:
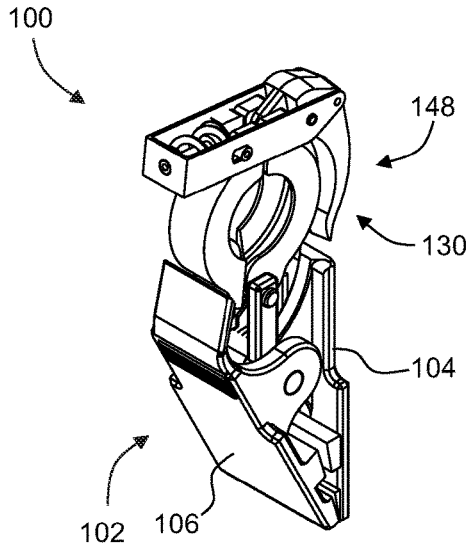
FIG. 30 is a diagrammatic perspective view of another alternate example of an object-securable article-carrier clip apparatus in accordance with the present disclosure, wherein the object securement subassembly includes a clamp element with a lever arm mechanism by which the clamp element may lock in and released from its clamped configuration.
Figure 31:
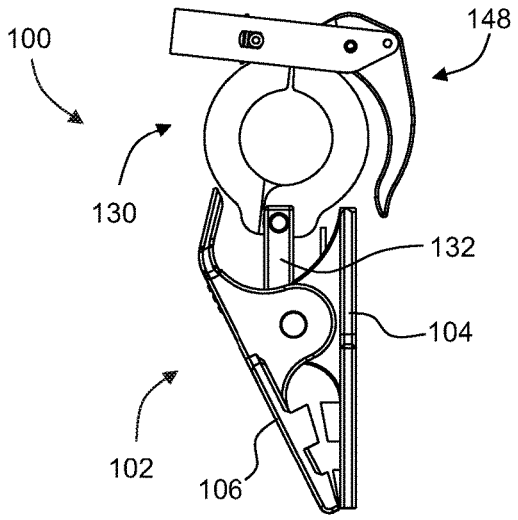
FIG. 31 is a diagrammatic side view of the object-securable article-carrier clip apparatus of FIG. 30.
Figure 32:
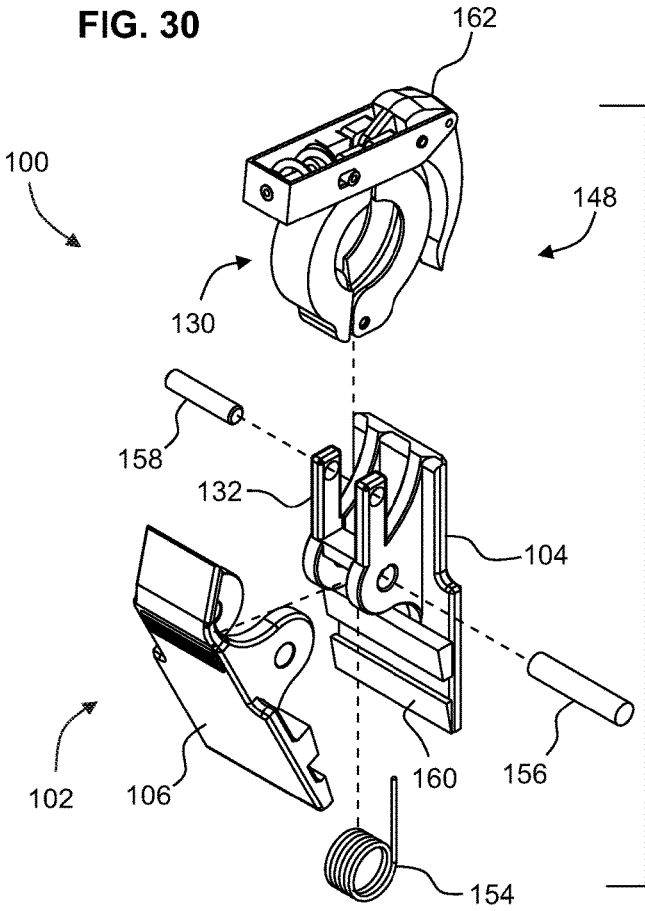
FIG. 32 is a diagrammatic exploded view of the object-securable article-carrier clip apparatus of FIG. 30.
Figure 33:
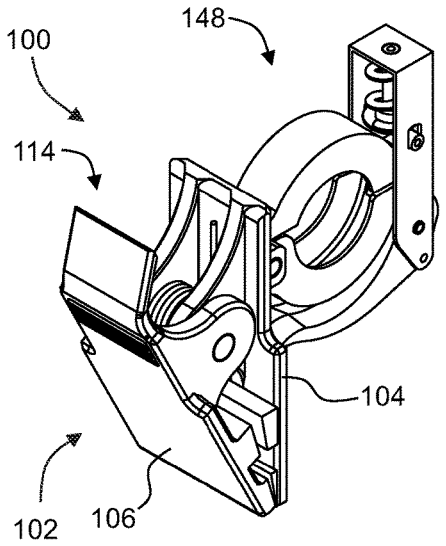
FIG. 33 is a diagrammatic perspective view of another alternate example of an object-securable article-carrier clip apparatus in accordance with the present disclosure, wherein the securement clamp element is similar to that of the example in FIG. 30, but is secured to the external face of the first grip element.
Figure 34:
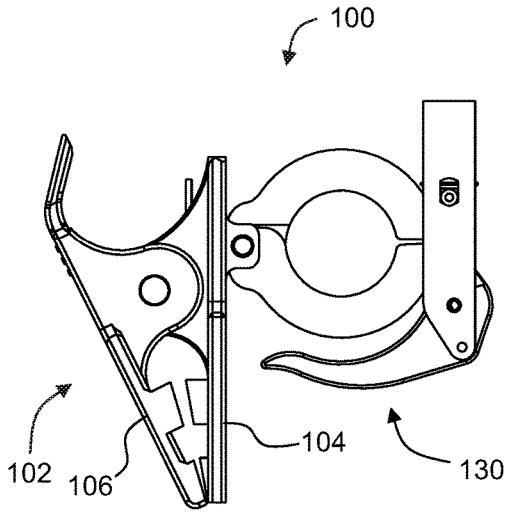
FIG. 34 is a diagrammatic side view of the object-securable article-carrier clip apparatus of FIG. 33.
Figure 35:
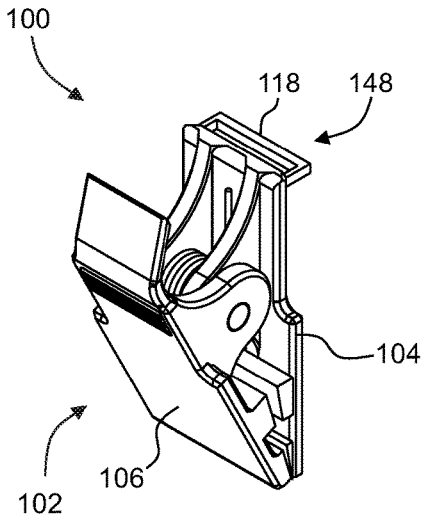
FIG. 35 is a diagrammatic perspective view of another alternate example of an object-securable article-carrier clip apparatus in accordance with the present disclosure.
Figure 36:
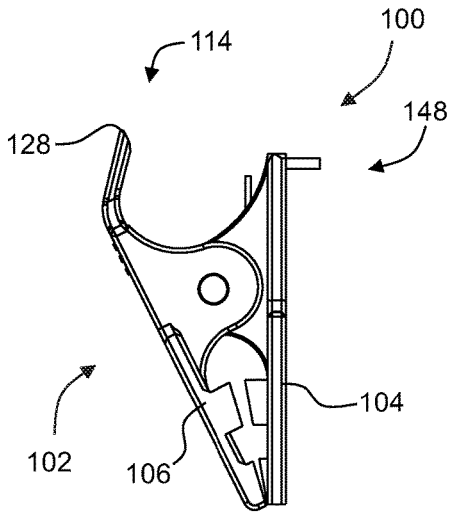
FIG. 36 is a diagrammatic side view of the object-securable article-carrier clip apparatus of FIG. 35.
Figure 37:
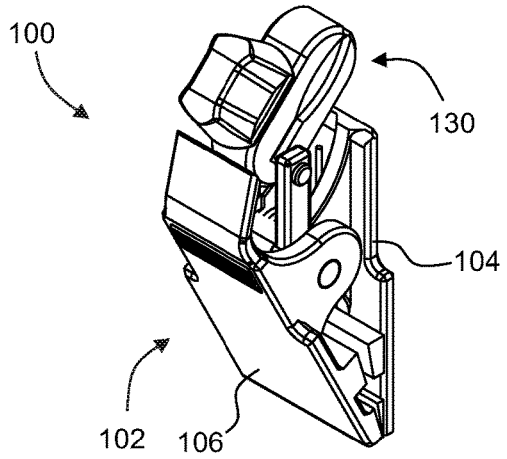
FIG. 37 is a diagrammatic perspective view of another alternate example of an object-securable article-carrier clip apparatus in accordance with the present disclosure.
Figure 38:
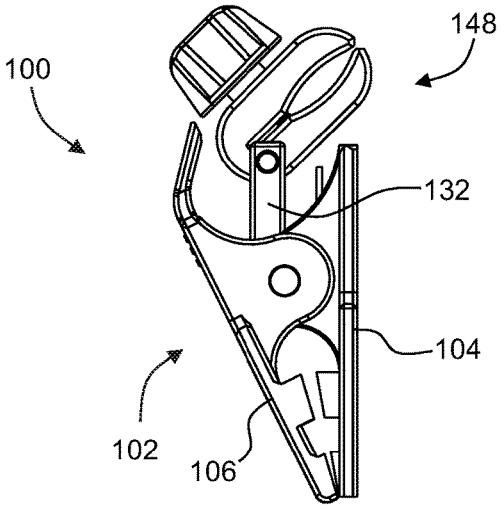
FIG. 38 is a diagrammatic side view of the object-securable article-carrier clip apparatus of FIG. 37.
Figure 39:
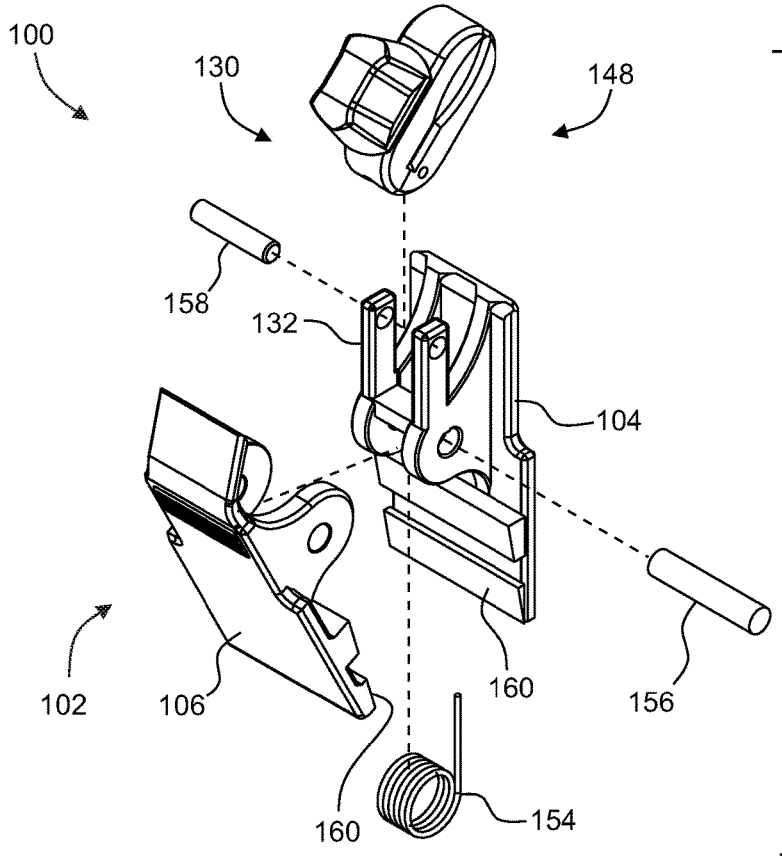
FIG. 39 is a diagrammatic exploded view of the object-securable article-carrier clip apparatus of FIG. 37.
Figure 40:
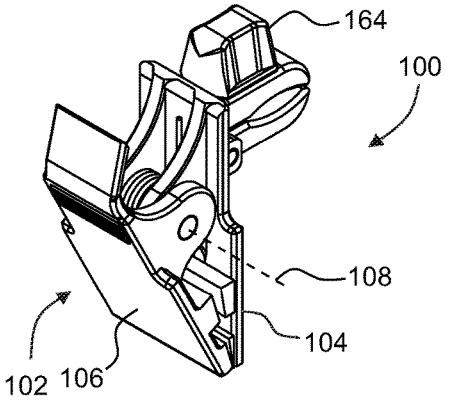
FIG. 40 is a diagrammatic perspective view of another alternate example of an object-securable article-carrier clip apparatus in accordance with the present disclosure, wherein rotation of the clamp actuation knob causes the jaws of the securement clamp element to rotate relative to one another between their clamping and unclamping configurations.
Figure 41:
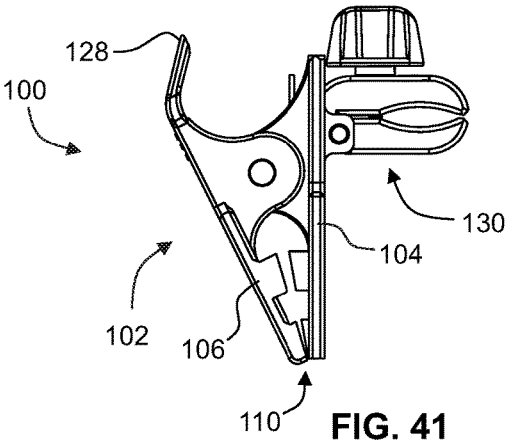
FIG. 41 is a diagrammatic side view of the object-securable article-carrier clip apparatus of FIG. 40.
Figure 42:
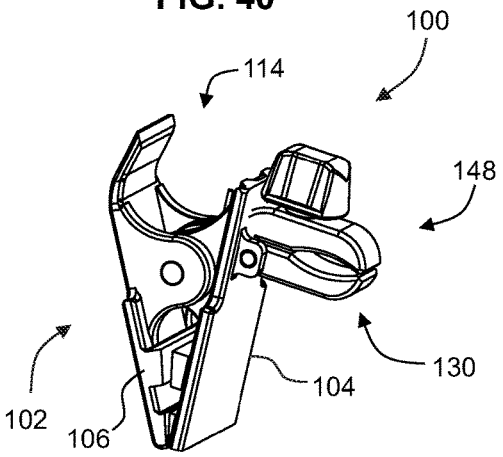
FIG. 42 is a further diagrammatic perspective view of the object-securable article-carrier clip apparatus of FIG. 40.
Figure 43:
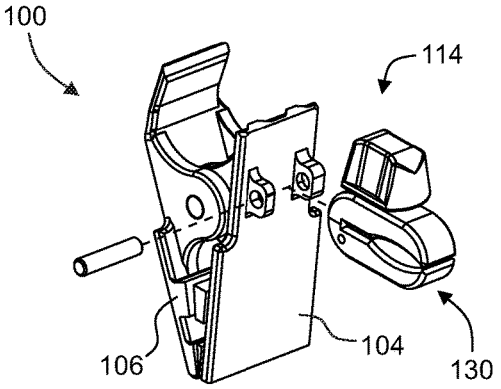
FIG. 43 is a diagrammatic partially-exploded view of the object-securable article-carrier clip apparatus of FIG. 40.
Figure 44:
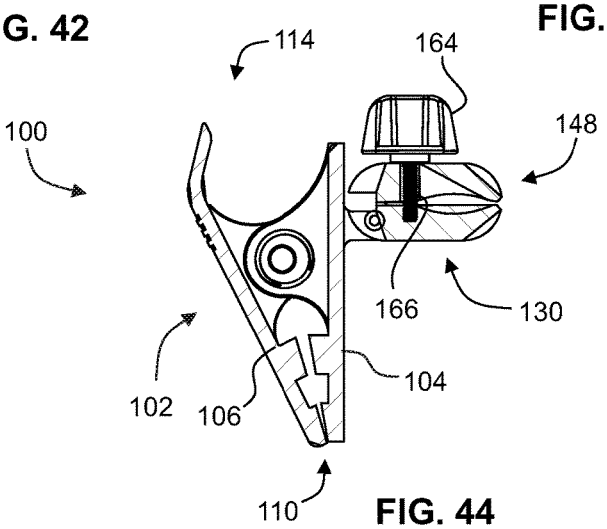
FIG. 44 is a diagrammatic cross-sectional view of the object-securable article-carrier clip apparatus of FIG. 40.
Figure 45:
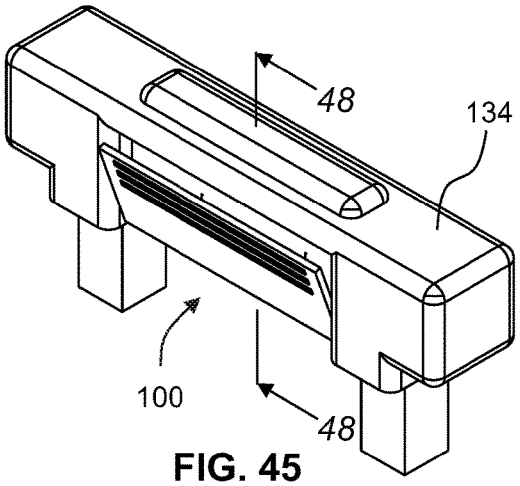
FIG. 45 is a diagrammatic partial perspective view of one example of a luggage item having an extendable handle portion in accordance with the present disclosure, wherein a grip subassembly is affixed to the handle portion and is partially received by a recess in the handle portion.
Figure 46:
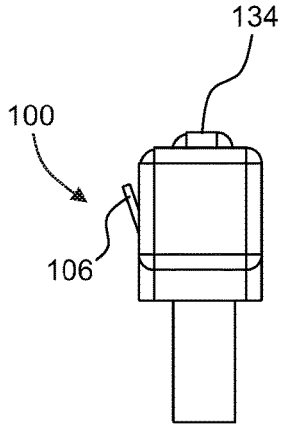
FIG. 46 is a diagrammatic side view of the example portion of a luggage item shown in FIG. 45.
Figure 47:
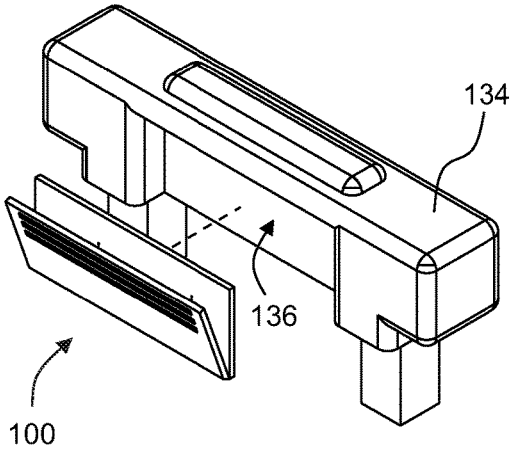
FIG. 47 is a diagrammatic partially-exploded view of the example portion of a luggage item shown in FIG. 45.
Figure 48:
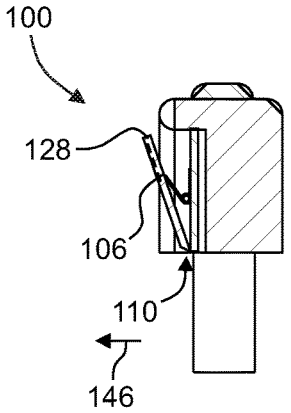
FIG. 48 is a diagrammatic cross-sectional view taken along lines 48-48 in FIG. 45.
Figure 49:
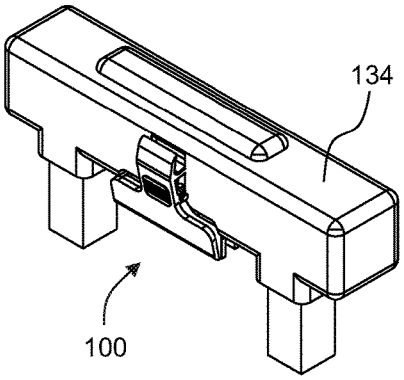
FIG. 49 is a diagrammatic partial perspective view of an alternate example of a luggage item having an extendable handle portion in accordance with the present disclosure, wherein a grip subassembly is affixed to the handle portion and is partially received by a recess in the handle portion, and the second grip element at least partially protrudes outwardly of the handle portion.
Figure 50:
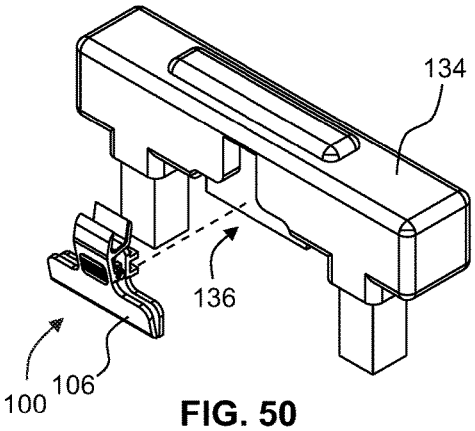
FIG. 50 is a diagrammatic partially-exploded view of the example portion of a luggage item shown in FIG. 49.
Figure 51:
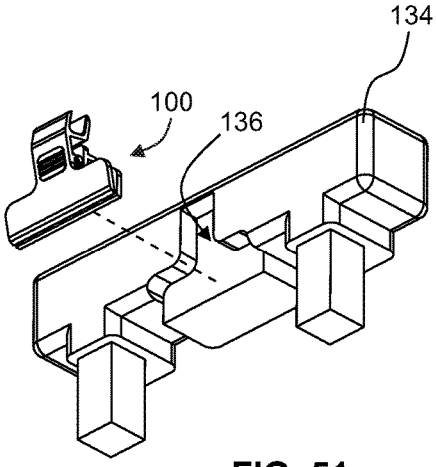
FIG. 51 is a further diagrammatic partially-exploded view of the example portion of a luggage item shown in FIG. 49.
Figure 52:
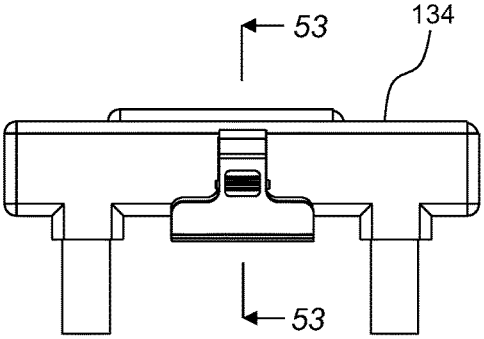
FIG. 52 is a diagrammatic front view of the example portion of a luggage item shown in FIG. 49.
Figure 53:
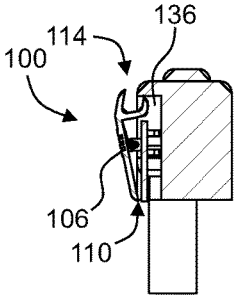
FIG. 53 is a diagrammatic cross-sectional view taken along lines 53-53 in FIG. 52.
Figure 54:
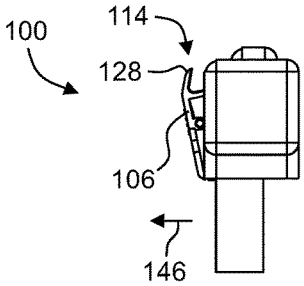
FIG. 54 is a diagrammatic side view of the example portion of a luggage item shown in FIG. 49; wherein the auxiliary support portion is shown partially exposed outwardly of the handle portion.

A grip subassembly 102 may preferably include a first grip element 104 and a second grip element 106 pivotably attached to one another about a pivot axis 108 (e.g., by way of a grip axle 156), thereby allowing pivoting movement of the second grip element 106 between a grip position (see, for example, FIGS. 11 and 19) and a release position (see, for example, FIGS. 12 and 20) with respect to the first grip element 104. The second grip element 106 may preferably be being resiliently biased toward the grip position. Such resiltient bias may be provided by a spring element 154 or the like.

The grip subassembly 102 may be further include a mouth portion 110 defined between the first and second grip elements. The mouth portion 110 may be configured to receive and release a said article 112 (for example, a jacket or secondary travel bag) when the second grip element 106 is in the release position. The mouth portion 110 may also be configured to grippingly retain the article 112 when the second grip element 106 is in the grip position. An inner grip surface 160 may be, for example, a felt pad article protector incorporated to protect an article from general wear.

Figure 3:
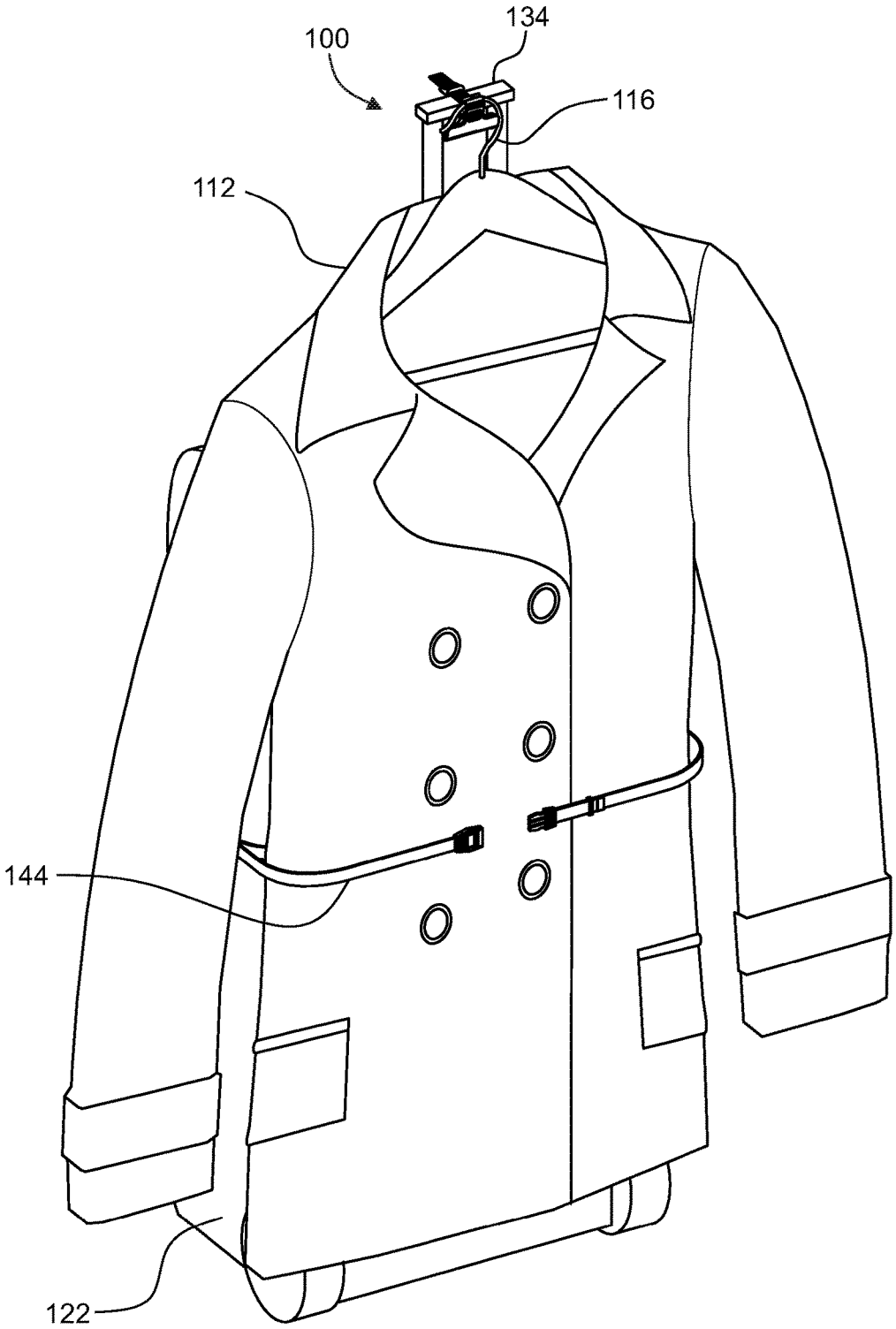
FIG. 3 is a diagrammatic perspective view of one example object-securable article-carrier kit in accordance with the present disclosure, wherein a supportive component of the carried article is shown suspendedly received by an auxiliary support portion of the grip subassembly, and article strap portions of the article strap subsystem are in partial wrapping engagement with the article.
Figure 4:
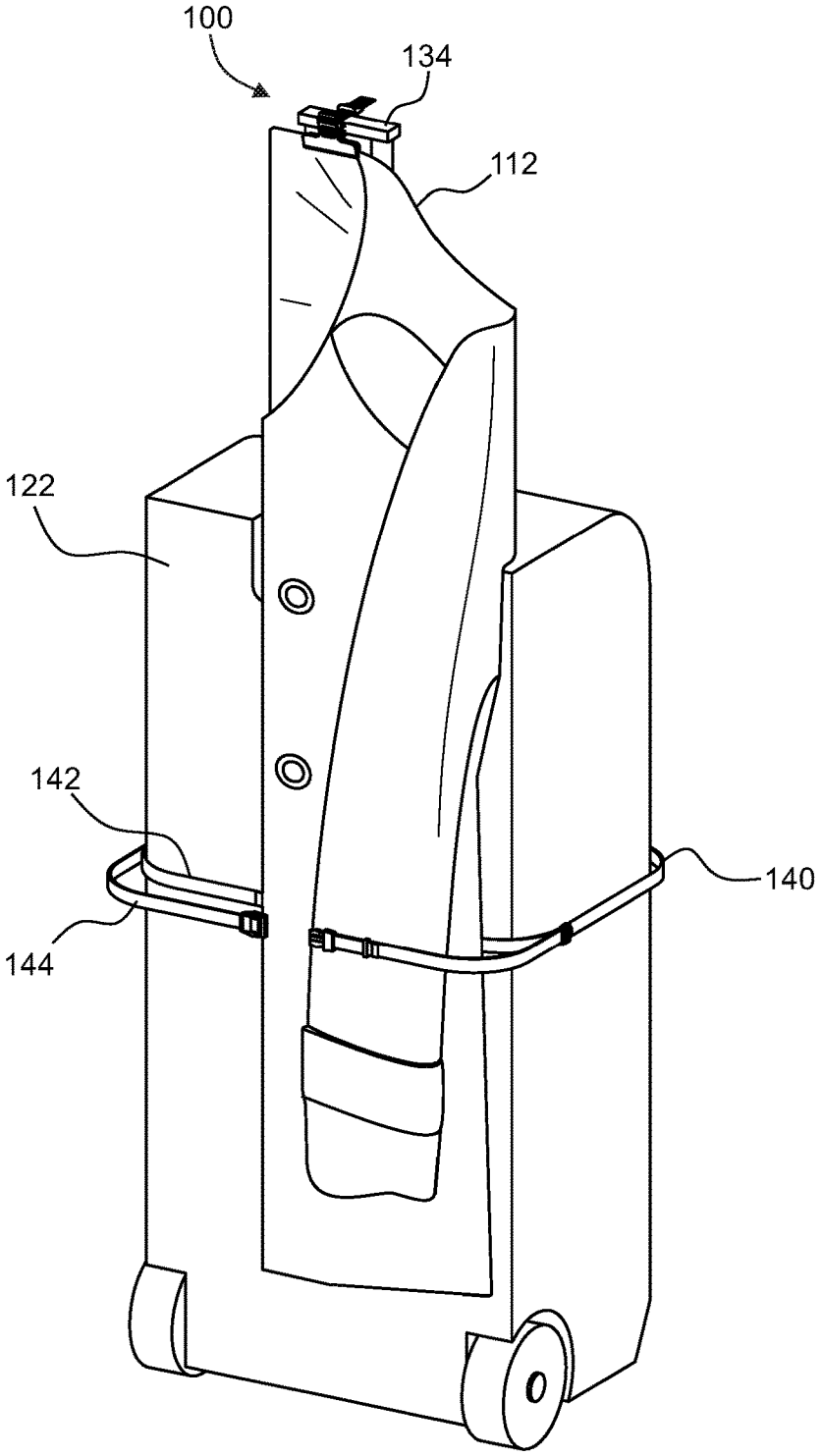
FIG. 4 is a diagrammatic perspective view of a kit similar to that of FIG. 3, but wherein the top of the article is grippingly retained in the mouth portion of the respective grip subassembly.
Figure 5:
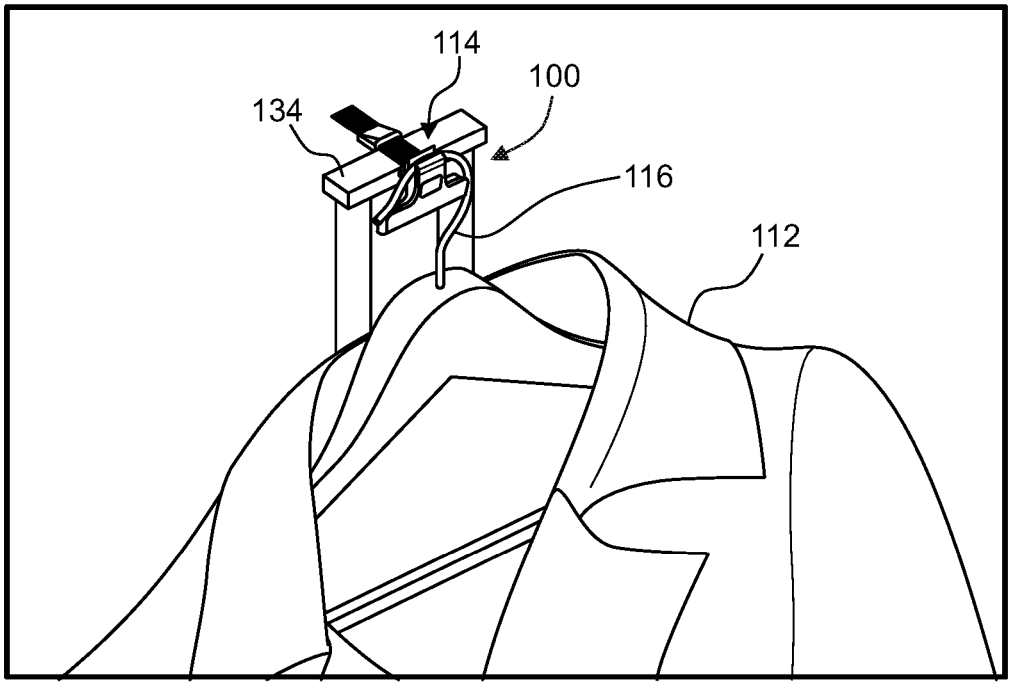
FIG. 5 is a diagrammatic magnified view of the upper part of FIG. 3.

Certain preferred embodiments of a grip subassembly 102 may also include an auxiliary support portion 114 configured to suspendingly receive a supportive component 116 of the article 112. Examples of such a supportive component 116 may include a coat hanger as illustrated in FIGS. 3 and 5 or the strap of a purse or secondary luggage bag.

An object securement subassembly 148 may be configured to secure the grip subassembly 102 to an object 122. Such securement would preferably be strong enough to transfer most or all of the article's load (e.g., loading resulting from the article's weight, momentum or contact with other surrounding objects) to the object 122 at the securement location (for example, a telescoping handle portion 134 of the object 122). Moreover, such securement should preferably be resistant to loosening as a result of repeated movement and shaking of the object over extended distances and time periods, such as a traveler might experience while rolling a luggage item 122 between ground transportation and a commercial aircraft departure gate.

Referring to FIGS. 9-11 and 35, in particular embodiments of an object-securable article-carrier clip apparatus 100, the object securement subassembly 148 may include at least one strap securement loop 118 affixed, for example, to the first grip element 104. Moreover, the object securement subassembly 148 may further include an object securement strap 120 configured to (a) extend through the at least one strap securement loop 118, and (b) wrap around a portion of the object 122 to releasably secure the grip subassembly 102 to the object 122 by way of the at least one strap securement loop 118.

The object securement strap 120 may include a cam buckle element 124 by which the releasable securement is enabled and tightenable (for example, around the handle portion of a luggage item 122).

Referring to FIG. 1, in particular embodiments of an object-securable article-carrier clip apparatus 100, an auxiliary support portion 114 may include an article support groove 126 which may open oppositely of the mouth portion 110. The article support groove 126 may be formed integrally with the second grip element 106, for example during an injection molding process. Alternatively or in addition, an auxiliary support portion 114 may include an article retention lip 128 which may also extend oppositely of the mouth portion 110. The article retention lip 128 may also be formed integrally with the second grip element 106.

Referring to FIGS. 18-34 and 37-44, in certain preferred embodiments of an object-securable article-carrier clip apparatus 100, the object securement subassembly 148 may include at least one securement clamp element 130 actuatable between clamping and unclamping configurations. In certain such embodiments, like the ones illustrated in FIGS. 25-32 and 37-44, the securement clamp element 130 may include two complementary jaw elements with various means for controlling how the respective jaw elements may rotate or separate from one another. By way of example, the actuation may be threaded actuation enabled by a threaded shaft 166 rigidly attached to a rotatable clamp actuation knob 164.

Referring to FIGS. 25-27, 33-34 and 40-44, the securement clamp element 130 may be attached to the first grip element 104. This attachment may be pivotable or rigid. The rigid attachment may be by way of, for example, threaded fastener, rivet, adhesive joint, weld joint, a combination thereof or the like. Referring to FIGS. 30-32 and 37-39, the securement clamp element 130 may be connected to the grip subassembly 102 by way of one or more clamp extension arms 132, which may themselves be attached to of formed as part of the first grip element 104. In certain embodiments, the securement clamp element 130 may be connected to the grip subassembly at or near the pivot axis 108.

In particular embodiments of an object-securable article-carrier clip apparatus 100, the securement clamp element 130 may be at least partially pivotable with respect to the grip subassembly 102. Moreover, the securement clamp element 130 may be held in place by a clamp detent rod.

Referring to FIGS. 45-54, in certain embodiments of an object-securable article-carrier clip apparatus 100, the grip subassembly 102 may be affixed to a handle portion 134 of an object 122 such as a rollable suitcase. In such embodiments, the grip subassembly 102 may preferably be at least partially received by a recess 136 in the handle portion 134. The affixing may be by way of, for example, permanent or non-permanent snap-fit, one or more threaded fasteners, rivets, weld joint, adhesive joint, some combination thereof or the like.

Referring to FIGS. 1-4, an object-securable article carrier kit may comprise an object-securable article-carrier clip apparatus 100 in accordance with the present disclosure, and an article strap subsystem 138. An article strap subsystem 138 may include a base strap portion 140, a pair of object strap portions 142 and a pair of article strap portions 144. The base strap portion 140 and object strap portions 142 may be collectively configured to be secured in wrapping engagement around the object 122. The base strap portion 140 and the article strap portions 144 may be collectively configured to be fastened in retaining engagement around the object and the article to facilitate retention of the article against the object (e.g., luggage item) to keep the article secured in place for transport.

Referring to FIGS. 45-54, a luggage item may have an extendable handle portion 134 and may comprise an object-securable article-carrier clip apparatus 100 having a grip subassembly 102, wherein the grip subassembly 102 may be affixed to the handle portion 134. This affixing may be by way of, for example, permanent or non-permanent snap-fit, one or more threaded fasteners, rivets, weld joint, adhesive joint, some combination thereof or the like. In such a luggage item, the object-securable article-carrier clip apparatus 100 may include an auxiliary support portion 114 having an article retention lip 128 which extends oppositely of the mouth portion 110. Additionally or in the alternative, the grip subassembly 102 may be at least partially received by a recess in the handle portion, and the second grip element 106 may at least partially protrude outwardly 146 of the handle portion 134 when the second grip element 106 is in its grip position. In such embodiments of a luggage item, the grip subassembly 102 may include an auxiliary support portion 114 configured to suspendingly receive a supportive component 116 of the article 112, and the auxiliary support portion 114 may be at least partially exposed outwardly 146 of the handle portion 134 when the second grip element 106 is in the grip position.

The present disclosure describes an article carrier system (which may otherwise be referred to herein as an apparatus) and kit that allows a desired article to be stored hands-free, while enabling continuous, direct physical access to said article during transport. The invention described herein addresses the current limits of article storage and transport as explained above in the Background section. In the present invention, and in certain embodiments of the disclosure, a desired article may be stored for easy access and transport.

Figure 6:
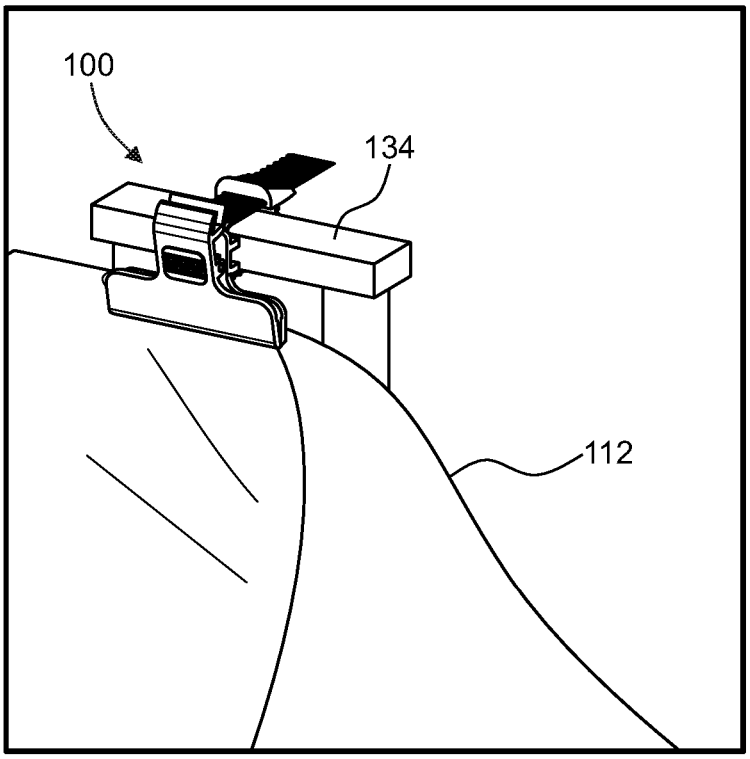
FIG. 6 is a diagrammatic magnified view of the upper part of FIG. 4.
Figure 7:
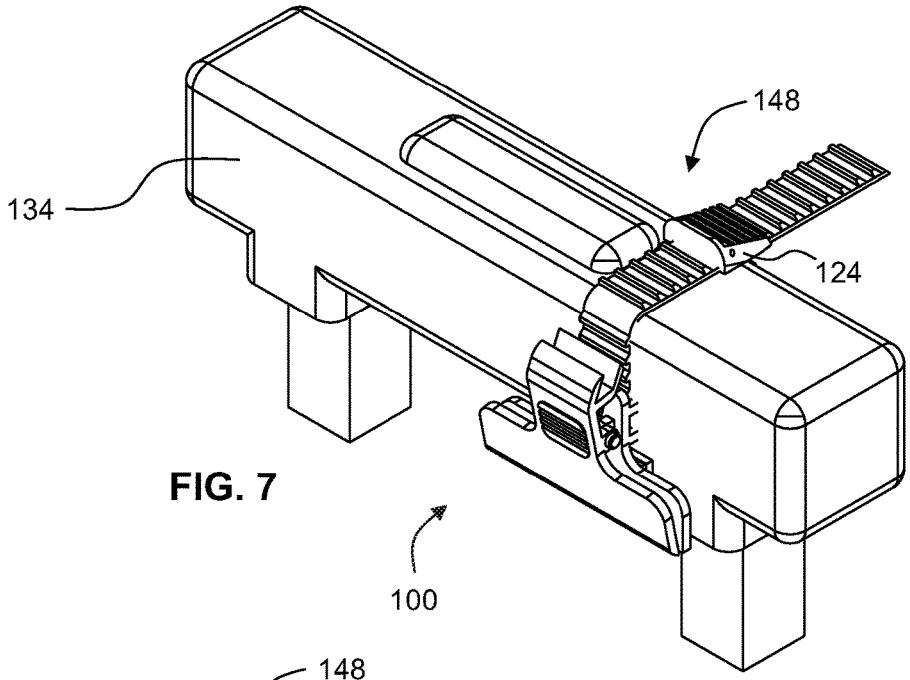
FIG. 7 is a diagrammatic partial perspective view illustrating one example of an object-securable article-carrier clip apparatus deployed on the handle portion of the an object, wherein the respective object securement subassembly is shown securing the grip subassembly to the handle portion.
Figure 8:
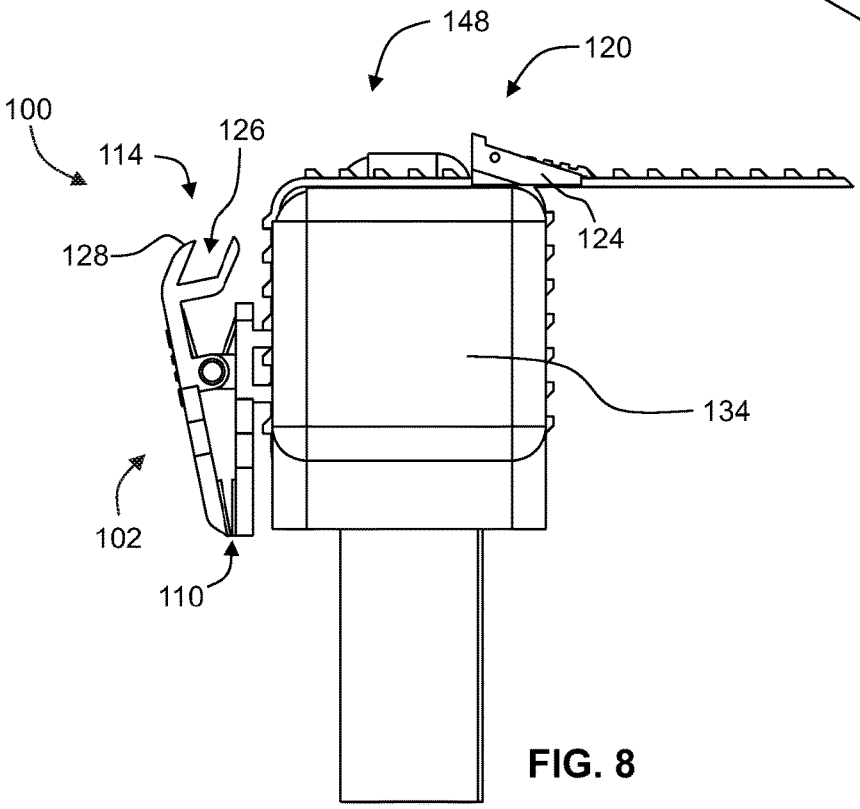
FIG. 8 is a diagrammatic partial side view of the components and configuration shown in FIG. 7.
Figure 9:
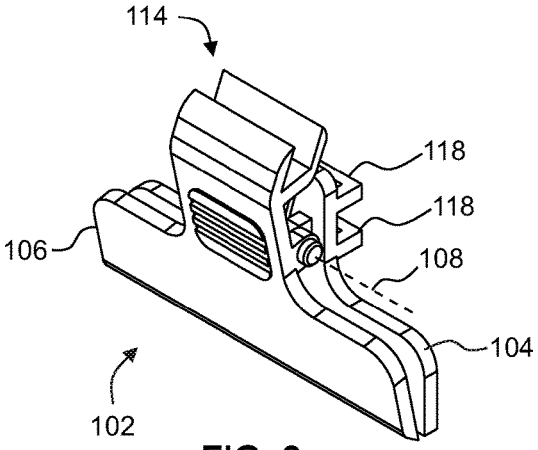
FIG. 9 is a diagrammatic perspective view one example grip subassembly in accordance with the present disclosure.
Figure 10:
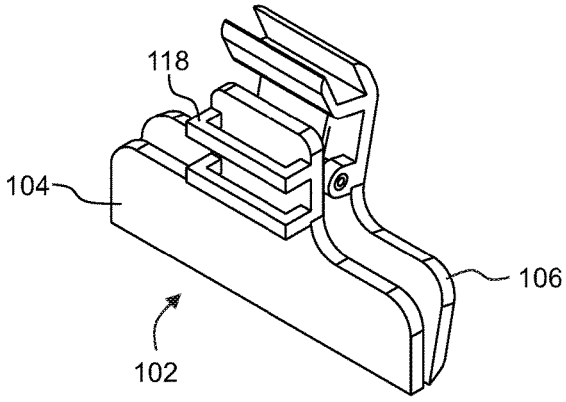
FIG. 10 is a further diagrammatic perspective view of the example grip subassembly shown in FIG. 9.

The buckled strap (otherwise generally referred to herein as an article strap subassembly 138) may optionally be used to further secure an article in place during travel. The buckled strap may be wrapped around both the desired article as well as the perimeter of an object. In a preferred embodiment, the object may be a luggage such as a carry-on roller bag. The buckled strap 138 may be fastened around the object 122 by way of engagement between the female object strap buckle 168 and male object strap buckle 170. Similarly, the article strap portions 144 may secure the article against the surface of the luggage by way of engagement between the female article strap buckle 172 and the male article strap buckle 174. The fastening mechanism may also be in other forms according to various applications, such as a snap hook, velcro strap, carabiner, and/or other fastening mechanisms that can be configured to fasten two free ends to each other. The article may also be suspended by one of the two modes of carriage illustrated for example in FIGS. 5 and 6. Embodiments of the apparatus, system and kit described herein could then be used to transport an article by, for example, dragging the luggage with to the desired destination. All of the methods of article transport described herein have the advantage of providing continuous, hands-free, direct physical access to the transported article, thus providing improved article carriage, storage, and transport. Those who desire immediate and continuous access to said article will benefit with such improved access.

Although certain preferred embodiments described herein make use of a handle portion of a luggage item for fastening the apparatus 100 to said handle portion, alternative embodiments of the present disclosure may utilize other transportable objects other than a luggage handle bar. For example, alternative embodiments may utilize other common travel gear on to which alternative embodiments might attach, such as the straps or hooks on a backpack, purse, doctor's bag, duffle bag, messenger bag, satchel, tote bag, or other comparable transportable travel gear.

Figure 13:
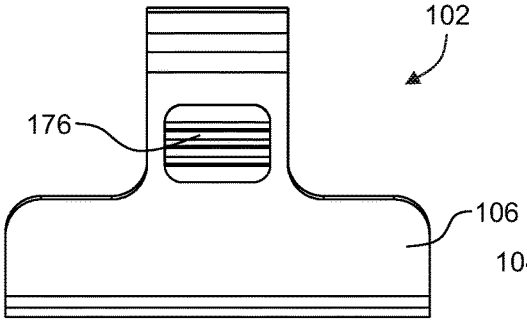
FIG. 13 is a diagrammatic front view of the example grip subassembly of FIG. 9.
Figure 14:
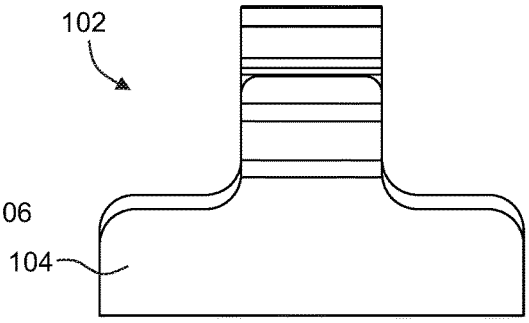
FIG. 14 is a diagrammatic rear view of the example grip subassembly of FIG. 9.

Referring to FIG. 13, a thumb grip 176 may be provided on the second grip element 106 to improve a person's grip as the second grip element 106 is depressed to open the mouth portion 110 for receiving the desired article 112.

Figure 15:
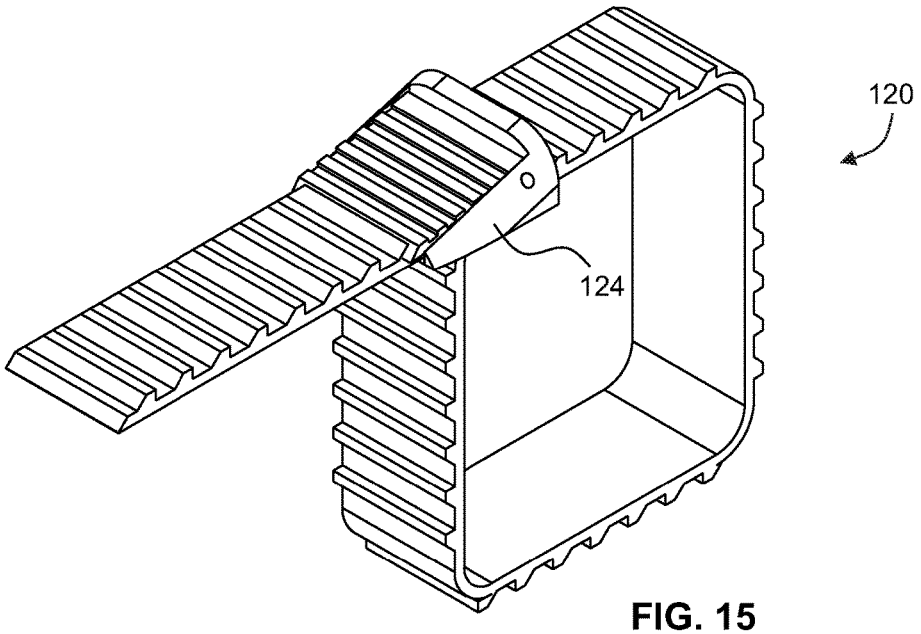
FIG. 15 is a diagrammatic perspective view of an example object securement strap which may form part of an object securement subassembly.
Figure 16:
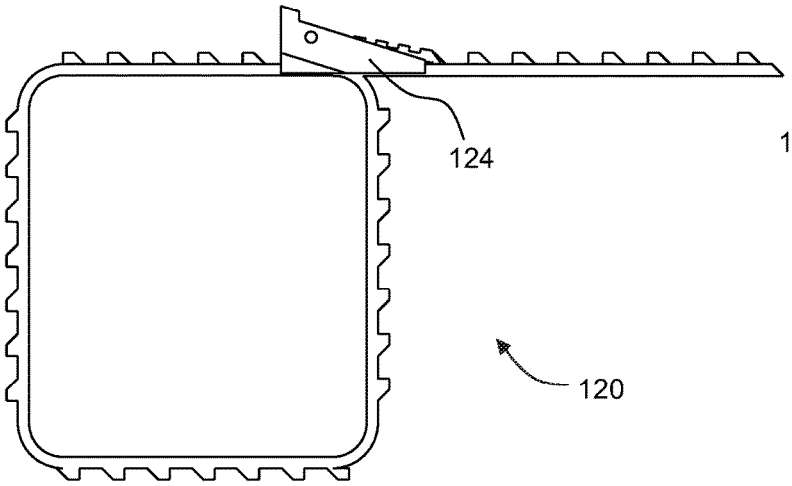
FIG. 16 is a diagrammatic side view of the example object securement strap shown in FIG. 15.
Figure 17:
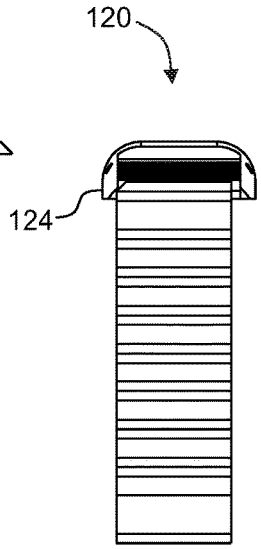
FIG. 17 is a diagrammatic front view of the example object securement strap shown in FIG. 15.
Figure 18:
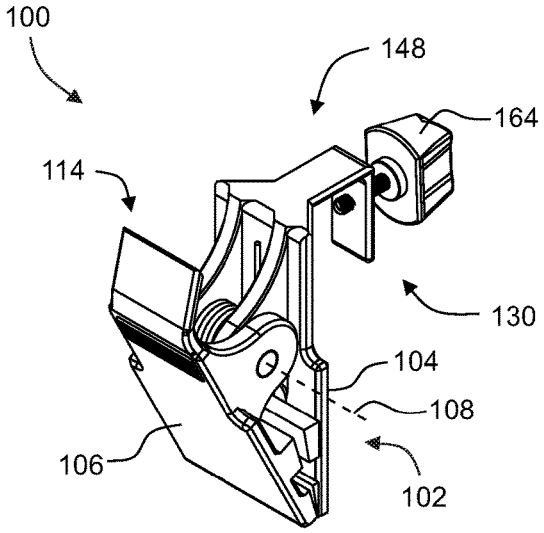
FIG. 18 is a diagrammatic perspective view of an alternate example of an object-securable article-carrier clip apparatus in accordance with the present disclosure, wherein the object securement subassembly includes a securement clamp element manually actuatable between clamping and unclamping configurations.

The object securement strap 120 illustrated in FIG. 15 may be a releasable cable tie component which is used to secure the grip subassembly 102 to an object, including but not limited to a luggage handle bar, strap of a backpack, and similar accessories. Within this view the overall height of Element 110 handle strap can be adjusted as deemed necessary and may be secured by inserting the ridged portion of the strap through a cam buckle element 124, which may include a spring bar, cam buckle base, and cam buckle clamp. This cam buckle element 124 allows for one to place handle strap in fixed position and to fasten firmly around an object when engaged. When cam buckle element 124 is not engaged, the handle strap can be removed or adjusted freely.

The transported example article 112 shown in FIGS. 3-6 is a jacket, although other garments or other desired articles may be transported using the present invention (including but not limiting to raincoat, pea coat, suit jacket, blazer, winter coat, scarf, hat, sweater, vest, t-shirt, suspenders). Even non-garment items may be used for transport, such as toiletry bags, documents, food items, or any other desired articles for transport.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An object-securable article-carrier clip apparatus comprising:

a grip subassembly including (a) a first grip element and a second grip element pivotably attached to one another about a pivot axis, thereby allowing pivoting movement of the second grip element between a grip position and a release position with respect to the first grip element, the second grip element being resiliently biased toward the grip position;

(b) a mouth portion defined between the first and second grip elements, the mouth portion being configured to receive and release a said article when the second grip element is in the release position, the mouth portion being configured to grippingly retain the article when the second grip element is in the grip position; and (c) an auxiliary support portion configured to suspendingly receive a supportive component of the article; and an object securement subassembly configured to secure the grip subassembly to an object;

wherein the grip subassembly is affixed to a handle portion of the object and the auxiliary support portion includes an article support groove which opens oppositely of the mouth portion.

2. An object-securable article-carrier clip apparatus as defined in claim 1, wherein the article support groove is formed integrally with the second grip element.

3. An object-securable article-carrier clip apparatus comprising:

a grip subassembly including (a) a first grip element and a second grip element pivotably attached to one another about a pivot axis, thereby allowing pivoting movement of the second grip element between a grip position and a release position with respect to the first grip element, the second grip element being resiliently biased toward the grip position;

(b) a mouth portion defined between the first and second grip elements, the mouth portion being configured to receive and release a said article when the second grip element is in the release position, the mouth portion being configured to grippingly retain the article when the second grip element is in the grip position; and (c) an auxiliary support portion configured to suspendingly receive a supportive component of the article; and an object securement subassembly configured to secure the grip subassembly to an object;

wherein the grip subassembly is affixed to a handle portion of the object and the auxiliary support portion includes an article retention lip which extends oppositely of the mouth portion.

4. An object-securable article-carrier clip apparatus as defined in claim 3, wherein the article retention lip is formed integrally with the second grip element.

5. An object-securable article-carrier clip apparatus comprising:

a grip subassembly including (a) a first grip element and a second grip element pivotably attached to one another about a pivot axis, thereby allowing pivoting movement of the second grip element between a grip position and a release position with respect to the first grip element, the second grip element being resiliently biased toward the grip position;

(b) a mouth portion defined between the first and second grip elements, the mouth portion being configured to receive and release a said article when the second grip element is in the release position, the mouth portion being configured to grippingly retain the article when the second grip element is in the grip position; and (c) an auxiliary support portion configured to suspendingly receive a supportive component of the article; and an object securement subassembly configured to secure the grip subassembly to an object;

wherein the grip subassembly is affixed to a handle portion of the object and the object securement subassembly includes at least one securement clamp element actuatable between clamping and unclamping configurations.

6. An object-securable article-carrier clip apparatus as defined in claim 5, wherein the actuation is a threaded actuation.

7. An object-securable article-carrier clip apparatus as defined in claim 5, wherein the securement clamp element is connected to the grip subassembly by way of a clamp extension arm.

8. An object-securable article-carrier clip apparatus as defined in claim 5, wherein the securement clamp element is attached to the first grip element.

9. An object-securable article-carrier clip apparatus as defined in claim 8, wherein the securement clamp element is at least partially pivotable with respect to the grip subassembly.

10. An object-securable article-carrier clip apparatus comprising:

a grip subassembly including (a) a first grip element and a second grip element pivotably attached to one another about a pivot axis, thereby allowing pivoting movement of the second grip element between a grip position and a release position with respect to the first grip element, the second grip element being resiliently biased toward the grip position;

(b) a mouth portion defined between the first and second grip elements, the mouth portion being configured to receive and release a said article when the second grip element is in the release position, the mouth portion being configured to grippingly retain the article when the second grip element is in the grip position; and (c) an auxiliary support portion configured to suspendingly receive a supportive component of the article; and an object securement subassembly configured to secure the grip subassembly to an object;

wherein (i) the object securement subassembly includes at least one securement clamp element actuatable between clamping and unclamping configurations, and (ii) the securement clamp element is connected to the grip subassembly at the pivot axis.

11. An object-securable article-carrier clip apparatus as comprising:

a grip subassembly including (a) a first grip element and a second grip element pivotably attached to one another about a pivot axis, thereby allowing pivoting movement of the second grip element between a grip position and a release position with respect to the first grip element, the second grip element being resiliently biased toward the grip position;

(b) a mouth portion defined between the first and second grip elements, the mouth portion being configured to receive and release a said article when the second grip element is in the release position, the mouth portion being configured to grippingly retain the article when the second grip element is in the grip position; and (c) an auxiliary support portion configured to suspendingly receive a supportive component of the article; and an object securement subassembly configured to secure the grip subassembly to an object;

wherein the grip subassembly is affixed to a handle portion of the object and is at least partially received by a recess in the handle portion.

12. A luggage item having an extendable handle portion, the luggage item comprising:

an object-securable article-carrier clip apparatus having a grip subassembly including (a) a first grip element and a second grip element pivotably attached to one another about a pivot axis, thereby allowing pivoting movement of the second grip element between a grip position and a release position with respect to the first grip element, the second grip element being resiliently biased toward the grip position; and (b) a mouth portion defined between the first and second grip elements, the mouth portion being configured to receive and release a said article when the second grip element is in the release position, the mouth portion being configured to grippingly retain the article when the second grip element is in the grip position; and an auxiliary support portion having an article retention lip which extends oppositely of the mouth portion;

wherein the grip subassembly is affixed to the handle portion.

13. A luggage item having an extendable handle portion, the luggage item comprising:

an object-securable article-carrier clip apparatus having a grip subassembly including (a) a first grip element and a second grip element pivotably attached to one another about a pivot axis, thereby allowing pivoting movement of the second grip element between a grip position and a release position with respect to the first grip element, the second grip element being resiliently biased toward the grip position; and (b) a mouth portion defined between the first and second grip elements, the mouth portion being configured to receive and release a said article when the second grip element is in the release position, the mouth portion being configured to grippingly retain the article when the second grip element is in the grip position;

wherein the grip subassembly is affixed to the handle portion and at least partially received by a recess in the handle portion.

14. A luggage item as defined in claim 13, wherein the second grip element at least partially protrudes outwardly of the handle portion when the second grip element is in the grip position.

15. A luggage item as defined in claim 14, wherein (a) the grip subassembly includes an auxiliary support portion configured to suspendingly receive a supportive component of the article; and (b) the auxiliary support portion is at least partially exposed outwardly of the handle portion when the second grip element is in the grip position.

* * * * *